US005823902A

United States Patent [19]

Guest et al.

[11] Patent Number: 5,823,902

[45] Date of Patent: Oct. 20, 1998

[54] NOCK ASSEMBLY FOR ARROWS

[76] Inventors: Elmer F. Guest, 31 Hancock St.; Leon A. Eckert, 30 Plain St., both of Fitchburg, Mass. 01420

[21] Appl. No.: 946,705

[22] Filed: Oct. 8, 1997

[51] Int. Cl.[6] ..... F42B 6/06

[52] U.S. Cl. ..... 473/578

[58] Field of Search ..... 473/578, 216; 403/348, 349

[56] References Cited

U.S. PATENT DOCUMENTS

| | | | |
|---|---|---|---|
| 135,655 | 2/1873 | Miller et al. | 403/349 X |
| 795,810 | 8/1905 | Bowe | 403/348 X |
| 1,194,793 | 8/1916 | Styers . | |
| 1,696,462 | 12/1928 | Victor | 403/349 |
| 2,484,589 | 10/1949 | Richards . | |
| 2,664,078 | 12/1953 | Irwin . | |
| 3,401,938 | 9/1968 | Bear . | |
| 3,425,695 | 2/1969 | Kestenbaum . | |
| 3,741,542 | 6/1973 | Karbo . | |
| 3,815,380 | 6/1974 | Esmay | 403/349 X |
| 3,945,642 | 3/1976 | Henthorn, Jr. . | |
| 4,029,319 | 6/1977 | Christen . | |
| 4,141,554 | 2/1979 | Sherwin . | |
| 4,266,782 | 5/1981 | Patterson . | |
| 4,305,588 | 12/1981 | Dodge . | |
| 4,645,211 | 2/1987 | Beiter . | |
| 4,722,531 | 2/1988 | Schram . | |
| 4,856,792 | 8/1989 | Hardison . | |
| 5,067,731 | 11/1991 | Bickel . | |
| 5,094,464 | 3/1992 | Musacchia, Sr. . | |
| 5,154,432 | 10/1992 | Saunders . | |
| 5,306,019 | 4/1994 | Guest et al. . | |

FOREIGN PATENT DOCUMENTS

| | | | |
|---|---|---|---|
| 2400522 | 9/1974 | Germany | 403/349 |

OTHER PUBLICATIONS

Archer's Bible, 1966–67, Mar. 1967, p. 61, Bow Fishing Arrows.

*Primary Examiner*—John A. Ricci
*Attorney, Agent, or Firm*—Blodgett & Blodgett, P.C.

[57] ABSTRACT

A nock assembly for an arrow having a rearwardly facing bore. The nock assembly includes an adapter and a nock. The adapter is mounted within the bore of the arrow, so that it is coaxial with the central longitudinal axis of the arrow. The adapter is fixed to the arrow in a predetermined angular position about the arrow axis relative to the vanes of the arrow. The adapter has a socket and a second rear opening to the socket. The nock has a head end and a bifurcated tail end. The nock is removably mounted to the adapter so that the head end of the nock is located within the socket of the adapter and the bifurcated tail end is outside of the socket. The nock assembly includes a pair of resiliently bendable locking pins that extend laterally from the head end of the nock and a forward end wall contained within the socket of the adapter, and perpendicular to the longitudinal axis of the arrow. The forward end wall has an aperture and a forward surface. The head end of the nock which contains the locking pins extends through the aperture so that the pins are in front of the forward surface of the forward end wall. The forward surface of the forward end wall has a pair of cam surface which taper gradually forward from the lateral portions of the aperture to a pair of depressions in the cam surface for causing the pins to bend when the nock is rotated relative to the adapter and for biasing the nock forwardly relative to the adapter. This retains the locking pins in the depression for maintaining the nock in a locking position relative to the adapter. A detent is also located at the rear end of the adapter and at the forward end of the tail end of the nock.

10 Claims, 4 Drawing Sheets

NOCK ASSEMBLY FOR ARROWS

CROSS-REFERENCE TO RELATED APPLICATIONS

Not applicable

STATEMENT REGARDING FEDERALLY SPONSORED RESEARCH OR DEVELOPMENT

This invention has been created without the sponsorship or funding of any federally sponsored research or development program.

BACKGROUND OF THE INVENTION

The field of invention relates generally to arrows with nock assemblies, and more particularly, pertains to replaceable nocks for arrows.

The nock is the rearmost assembly of an arrow that bears a rearwardly facing notch for engaging the string of a bow. The bowstring is engaged by the notch during the drawing back of the bowstring and during the release of the bowstring.

Of critical importance, is the proper alignment of the nock about the shaft axis of the arrow relative to the vanes. When the nock is properly aligned, and the arrow is positioned on the bow, one feather or vane is essentially above the notch, a second feather or vane is essentially below the notch, and the third feather or vane extends away from the bow. This positioning creates a minimum of interference between the feathers or vanes and the bow during the positioning and release of the arrow.

A well known problem in archery, especially during target practice, is the so called "Robin Hood" shot. In the Robin Hood shot, a second arrow, fired at a target, strikes the rearmost portion of the first arrow which is already imbedded in the target. The impact typically results in the destruction of the nock of the first arrow. In the context of a competition, or in the field, while hunting, replacement of a fixedly attached nock is not practical.

Replaceable, or removable arrow nocks are known. This allows for continued use of the same arrow. The replaceable nock has a base with a forwardly facing, conically shaped cavity. The cavity is designed to receive the rear tip of the arrow shaft which is also conically shaped. Within the cavity of the nock are inwardly projecting circular or spiral retaining ribs. These ribs contact and locally deform the rear tip of the arrow shaft, to secure the nock to the shaft. The ribs enable a damaged nock to be replaced without the need for glue.

Use of this particular nock is restricted to a solid shaft arrow. Further, the application of the nock to the end of the arrow causes a deformation of the end of the arrow shaft with the resultant damaging effect.

Another known removable nock has a mounting portion with an outer circumference which conforms to the inner diameter of the shaft of the arrow. The mounting portion is slidably, removably received within the shaft of the arrow.

Our U.S. Pat. No. 5,306,019 issued 26 Aug. 1994, "Arrow With Nock Assembly" discloses a removable nock assembly for an arrow. The nock assembly includes a tubular adapter which is fixedly positioned at the rear end of an arrow and a nock inserted within the adapter. A forward end of the nock extends through an aperture in a forward wall segment of the adapter. The forward wall segment is resiliently bendable. The forward surface of the forward wall segment has a cam surface. The forward end of the nock has a laterally extending pin for engaging the cam surface. The nock is rotated about its central longitudinal axis from a non-locking position in which the pin is aligned with a lateral portion of the aperture to a locking position in which the pin engages a depression in the cam surface for retaining the nock within the adapter. As the nock rotates from the non-locking position to the locking position, it slides along the cam surface and causes the forward wall segment to bend rearwardly.

This action biases the nock forwardly relative to the adapter. This creates a resistance to rotational movement of the nock, relative to the adapter, when the pin is located in the depression so that the nock is retained in its locking position. If the nock is damaged or broken during normal uses such as hunting or archery competition, the damaged nock is easily removed and replaced by a new nock. However, if the adapter is damaged, it cannot be readily replaced in the field. The nock is more likely to be damaged than the adapter. However, if any part of the retaining means is damaged, it is more likely to be the adapter portion of the retaining means rather than the nock portion thereof. Since the locking pin of the nock is rigid relative to inner end wall of the adapter it tends to be stronger than the inner end wall. Therefore, the end wall is more likely to break than the locking pin.

The interaction of the portion of the nock locking pin and inner end wall portion of the adapter create an axial biasing effect and resistance to rotation of the nock relative to the adapter. This enables the locking pin and inner end wall to function as retaining means to maintain the nock in a locking angular position with the adapter. This also means that outside forces tending to separate the nock and adapter are likely to be concentrated at the locking pin and inner end wall.

It is, therefore, a principal object of the present invention to provide an improved nock assembly of the type disclosed in our issued U.S. patent identified above in which the adapter portion of the assembly is substantially less likely to be damaged.

Another object of this invention is the provision of an improved arrow nock assembly in which the nock is held firmly in the locking position relative to the adapter.

It is another object of the invention to provide an arrow nock assembly which is capable of carrying a removable insert which contains an animal scent.

With these and other objects in view, as will be apparent to those skilled in the art, the invention resides in the combination of parts set forth in the specification and covered by the claims appended hereto.

BRIEF SUMMARY OF THE INVENTION

A nock assembly for an arrow which has a shaft with an outer cylindrical surface, a central longitudinal shaft axis, a bore which extends along the axis and a first rear opening to the bore. The nock portion of the nock assembly is replaceable in the event of damage to the nock or the desire for using a nock of a different style. The invention further permits the proper alignment of the nock with the vanes or feathers of the arrow, and the ability to positively lock the nock relative to the shaft of the arrow. The nock assembly includes an adapter for mounting within the bore at the first rear opening, so that it is coaxial with the shaft axis. The adapter is fixed to the shaft in a predetermined angular position about the shaft axis relative to the vanes of the arrow. The adapter has a socket and a second rear opening to the socket. The nock portion of the nock assembly has a head end and a bifurcated tail end. The nock is removably mounted to the adapter so that the head end is located within the socket of the adapter and the bifurcated tail end is outside of the socket. The nock assembly also includes retaining means for releasably locking the head end of the nock within the socket of the adapter so that the nock is in a fixed angular position about the shaft axis relative to the adapter and the vanes and in a fixed position lengthwise of the shaft axis relative to the second rear opening.

In the preferred embodiment, the nock assembly comprises a pair of locking pins that extend laterally from the head end of the nock and a forward end wall contained within the socket of the adapter, and perpendicular to a longitudinal axis of the shaft. The forward end wall has an aperture and a forward surface which faces away from the second rear opening. The aperture has a central portion and a pair of lateral portions. The head end of the nock has a reduced forward portion which contains the locking pins and which extends through the aperture so that the pins are in front of the forward surface of the forward end wall. The reduced forward portion of the nock and the pins are removable rearwardly through the aperture. The forward surface of the forward end wall has a pair of cam surface which taper gradually forward from the lateral portions of the aperture to a pair of depressions in the cam surface for releasably retaining the locking pins in the depression for retaining the nock in a locking position relative to the adapter. Detent means are also located at the rear end of the adapter and the forward end of the tail end of the nock.

BRIEF DESCRIPTION OF THE DRAWINGS

The character of the invention, however, may be best understood by reference to one of its structural forms, as illustrated by the accompanying drawings, in which.

DETAILED DESCRIPTION OF THE INVENTION

Figure 1:
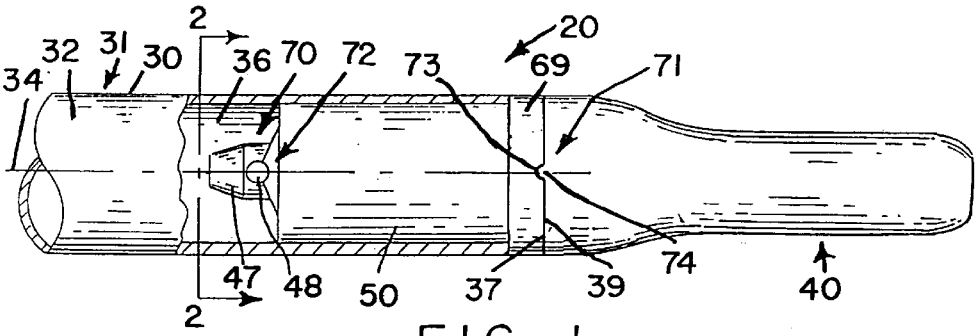
FIG. 1 is a side elevational view of a nock assembly, embodying the principals of the present invention and shown applied to the rear end of an arrow.

Referring first to FIG. 1, a nock assembly, embodying the principles of the present invention, generally indicated by the reference numeral 20. The nock assembly 20 is shown in FIG. 1 mounted in the rear portion of an arrow which is generally indicated by the reference numeral 31.

The arrow 31 has a shaft 30 with an outer cylindrical surface 32 and a central longitudinal shaft axis 34. The shaft 30 also has a bore 36 which extends along the central longitudinal shaft axis 34. The bore 36 has a first rear opening 38. The nock assembly 20 consists of an adapter, generally indicated by the reference numeral 50, and a nock, generally indicated by the reference numeral 40. The nock 40 is removably mounted to the adapter 50. The adapter 50 is positioned within the bore 36 at the first rear opening 38. The adapter 50 has a central longitudinal axis which is coaxial with the shaft axis 34, and is fixed to the shaft 30 in a predetermined angular position about the shaft axis 34, relative to the arrow feathers or vanes 25, see FIG. 16, which are fixed to the outer cylindrical surface 32 of the shaft 30.

Referring to FIGS. 4–6 and 13, the nock 40 comprises a head end, generally indicated by the reference numeral 42, and a bifurcated tail end, generally indicated by the reference numeral 44. The tail end 44 has a notch 45 for receiving the string of a bow. Each of a pair of grooves 41, begins at a junction 43 of the head end 42 and the bifurcated tail end 44, and extends longitudinally along at least a part of the head end 42. The tail end 44 has an annular forwardly facing surface 37 at the junction 43. A pair of protrusions 74 extend forwardly from the surface 37. The head end 42 has a reduced forward portion 47, which has an outer cylindrical surface 49 and a pair of locking pins 48 which extend laterally from the outer cylindrical surface 49. The locking pins 48 are resiliently bendable for a purpose to be described. The nock 40 has a central longitudinal nock axis 46.

The tail end 40 of the nock has a slot 76 at the forward portion thereof which is separated from the notch 45 by a wall 78. The wall 78 contains a hole 80 which extends from the notch 45 to the slot 76. A cavity 82 is located at the forward end of the slot. The slot 76 is adapted to receive a scent impregnated insert. The insert can be inserted into the slot 76 through the hole 80. The insert can be in the form of a pipe cleaner which is impregnated with a scent that is attractive to an animal being hunted. For example, an arrow with a scented insert can be shot from an animal blind to a target area for drawing the prey animal to the target area. When the insert is positioned within the slot 76, one end of the insert extends into the hole 80 and the other end of the insert extends into the cavity 82 for maintaining the insert within a slot 76. The nock 40 is constructed of a resiliently deformable material such as a plastic polymer.

Referring next to FIGS. 6 through 9, the adapter 50 has a socket 52 with a second rear opening 54, an inner cylindrical surface 55, and a rearwardly facing annular surface 39. The surface 39 has a pair of rearwardly facing depressions 73. A forward wall 56 is located at the forward end of the socket 52 of the adapter 50. The wall 56 is perpendicularly to the central longitudinal axis of the adapter. The forward wall 56 has a forward surface 58 which faces away from the second rear opening 54. The wall 56 of the adapter 50 also contains an aperture, generally indicated by the reference numeral 60 which consists of a central circular portion 66 and a pair of laterally extending portions 67. The central circular portion 66 is concentric with the central longitudinal axis of the adapter. The laterally extending portions 67 are contiguous with the central circular portion 66.

Figure 2:
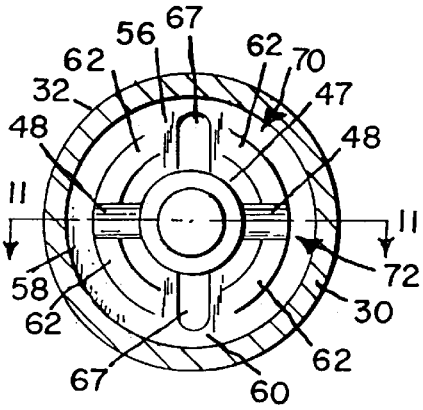
FIG. 2 is an enlarged vertical cross-sectional view of the nock assembly taken along the line 2—2 of FIG. 1 and looking in the direction of the arrows, showing the nock in its locking position.

A plurality of cam surfaces 62 are located on the forward surface 58 of the wall 56. Each cam surface 62 tapers gradually forward from one of the laterally extending portions 67 to a forwardmost point 64 adjacent a depression 65. The depressions 65 function as forward detent means, generally indicated by the reference numeral 72, for the pins 48 when the nock 40 is combined with the adapter 50 in the locking mode, as shown in FIGS. 1 and 2. The depressions 73 and the protrusions 74 constitute rearward detent means, generally indicated by the reference numeral 71. The pins 48, forward detent means 72, and rearward detent means 71 constitute retaining means, generally indicated by the reference numeral 70, for maintaining the nock 40 in a locking or fixed position in the adapter 50.

The adapter 50 is constructed of a deformable resilient material such as a plastic polymer. The rear end of the adapter 50 is provided with an outwardly extending flange 69, which abuts the rear end of the arrow 31 when the adapter 50 is positioned within the bore 36.

Figure 11:
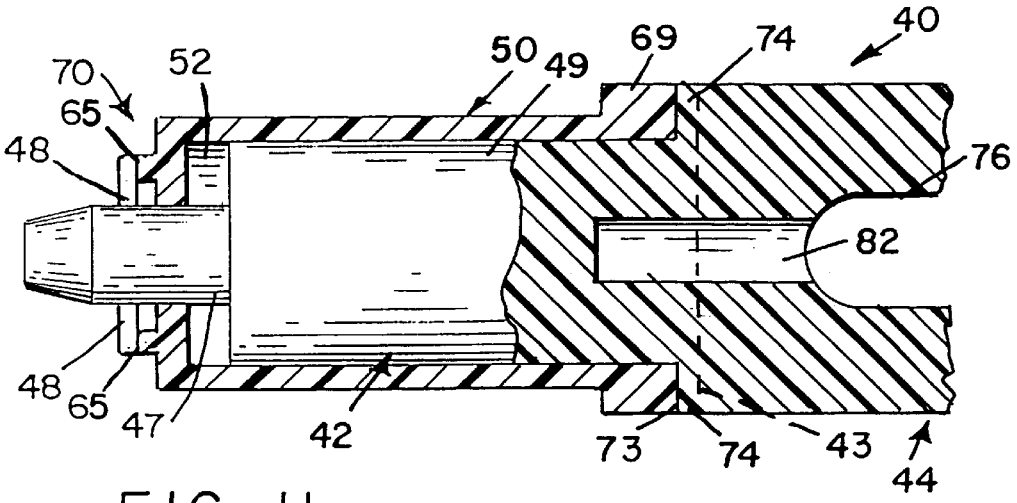
FIG. 11 is a vertical cross-sectional view of the nock assembly in the locking position, taken along the line 11—11 of FIG. 2 and looking in the direction of the arrows.

To allow for the mounting of the nock 40 to the adapter 50, the diameter of the inner cylindrical surface 55 of the adapter 50 is substantially the same as the outer cylindrical surface 49 of the nock 40, but they are provided with sufficient clearance to enable the head end 42 of the nock 40 to move within the socket 52 of the adapter 50. Reference should be had to FIG. 11. The locking pin 48 is also spaced from the inner cylindrical surface 55 of the adapter 50 when the reduced forward portion 47 of the nock 40 is within the socket 52 of the adapter 50.

Figure 3:
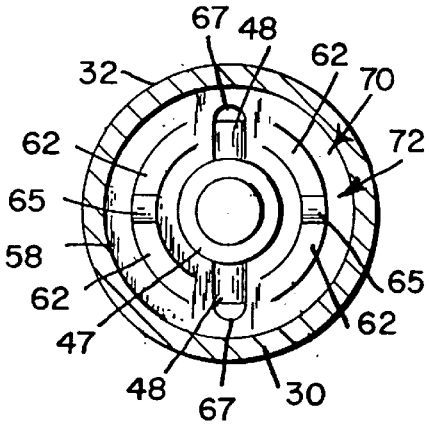
FIG. 3 is a vertical cross-sectional view, similar view to that of FIG. 2, showing the nock in its non-locking position.

The nock 40 is mounted to the adapter 50, by first inserting the nock 40 into the socket 52 in the non-locking angular position, the reduced forward portion 47 of the nock extends into the central circular portion 66 of the aperture 60 in the wall 56 of the adapter 50. At the same time, the locking pins 48 of the nock 40 extends through the radially extending portions 67 of the aperture 60 in the wall 56 of the adapter 50. The aperture 60 is shaped so that the reduced forward portion 47 and the locking pins 48 can pass freely through the aperture 60 when the nock 40 is in the non-locking angular position relative to the shaft axis 34. See FIG. 3. The reduced forward portion 47 and the locking pin 48 are also removable rearwardly through the aperture 60.

Figure 12:
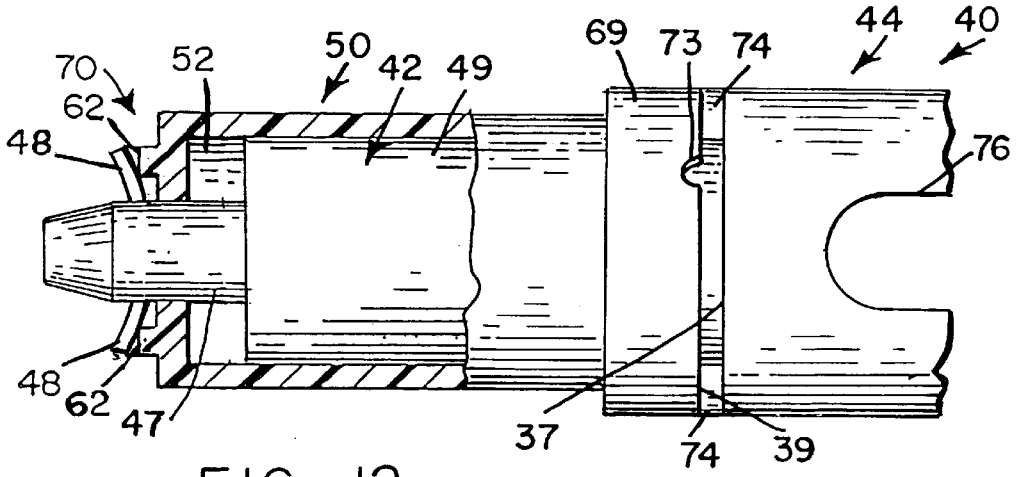
FIG. 12 is a cross-sectional view, similar to FIG. 11, showing the nock between the locking position and the non-locking position.

When the nock 40 is in the non-locking angular position, the locking pins 48 are forward of the forward surface 58 of the wall 56. The detent means 72 releasably retains the locking pin 48 when the nock is in a fixed or locking angular position. See FIGS. 1, 2, and 11. The protrusions 74 abut the rearwardly facing surface 39 of the adapter 50 so that the forwardly facing surface 37 of the nock 40 is spaced from the surface 39 as shown in FIG. 12. When the nock 40 is rotated about its own axis 46 and the shaft axis 34 from the non-locking angular position to the locking angular position, the locking pins 48 slide along the cam surfaces 62 from the lateral portions 67 of the aperture 60 to the depression 65 of the cam surfaces 62. At the same time, the protrusions 74 slide along the rearwardly facing surface 39 of the adapter. The forward wall 56 is rigid relative to the locking pins 48. As the pins 48 slide along the cam surfaces 62, they bend forwardly as shown in FIG. 12. Since the pins 48 are resiliently bendable, they create a biasing force for urging the nock 40 forwardly relative to the adapter 50. When the pins 48 reach the depressions 65, they snap into the depressions. At the same time, the protrusions 74 snap into the depressions 73, as shown in FIG. 11. This locks the nock 40 in a fixed angular position relative to the adapter 50. The nock 40 is removed from the adapter 50 by rotating the nock about its central longitudinal axis relative to the adapter 50 from the locking position, shown in FIG. 11, to the non-locking position shown in FIG. 3. The pins 48 are forced out of the depressions 65 and the protrusions 74 are forced out of the depressions 73 against the biasing effect of the pins 48. When the nock 40 reaches the non-locking position of FIG. 3, it can be removed axially from the socket 52 of the adapter.

The invention having been thus described, the operation will now be clear to those of ordinary skill in the art as described below.

Figure 16:
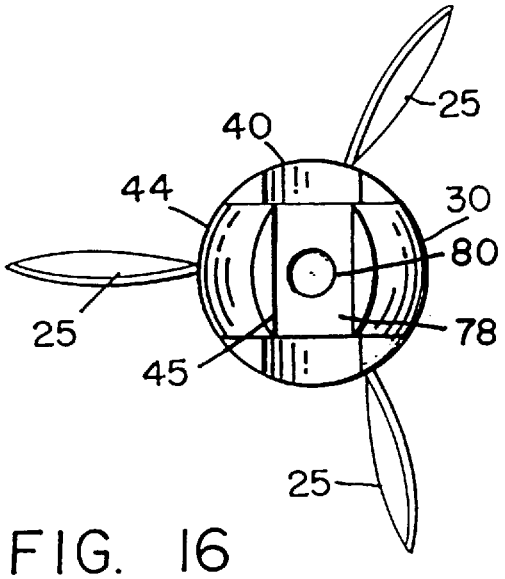
FIG. 16 is a rear end view of the nock assembly shown applied to a fletched arrow.

The adapter 50 is mounted within the bore 36 of the arrow shaft 30 at the first rear opening 38, and is positioned longitudinally parallel to the shaft axis 34. The nock 40 is removably mounted to the adapter 50 so that the head end 42 of the nock 40 is located within the socket 52 of the adapter 50, and the bifurcated tail end 44 of the nock 40 is located outside of the socket 52. With the nock 40 mounted to the adapter 50 in the locked position, the adapter 50 is fixed to the shaft 30, typically with an appropriate glue, so that the adapter 50 is in a predetermined angular position about the shaft axis 34, relative to the vanes 25. As shown in FIG. 16, the angular position is selected so that when a bowstring is in the notch 45 of the mounted nock 40, one vane 25 will be essentially above the notch 45, a second vane 25 will be essentially below the notch 45, and a third vane 25 will extend horizontally away from the bowstring.

When the nock 40 is mounted in its locked position within the socket 52 of the adapter 50, the nock 40 is in a fixed angular position about the shaft axis 34 relative to the adapter 50 and the vane 25 and is in a fixed position lengthwise of the shaft axis 34, relative to the second rear opening 54 of the adapter 50. When the nock 40 is mounted to the adapter 50, the central longitudinal nock axis 46 is coaxial with the shaft axis 34.

Figure 4:
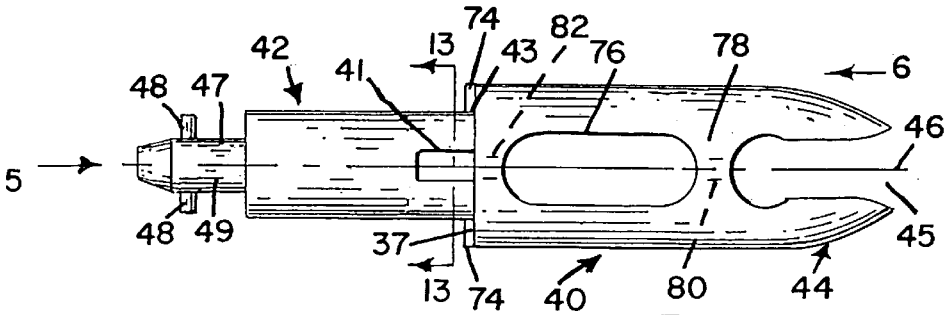
FIG. 4 is a top plan view of the nock portion of the nock assembly.
Figure 5:
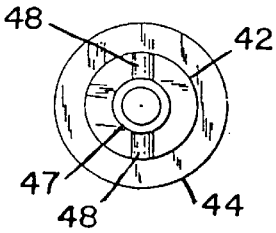
FIG. 5 is an end view of the nock, looking in the direction of arrow 5 of FIG. 4.
Figure 6:
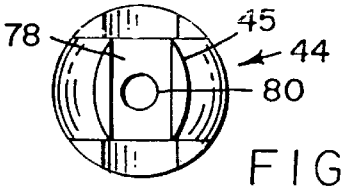
FIG. 6 is an end view of the nock, looking in the direction of arrow 6 of FIG. 4.
Figure 7:
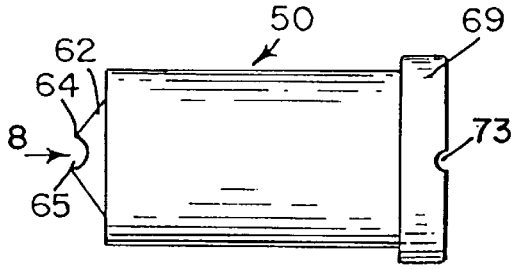
FIG. 7 is a side elevational view of an adapter portion of the nock assembly.
Figure 8:
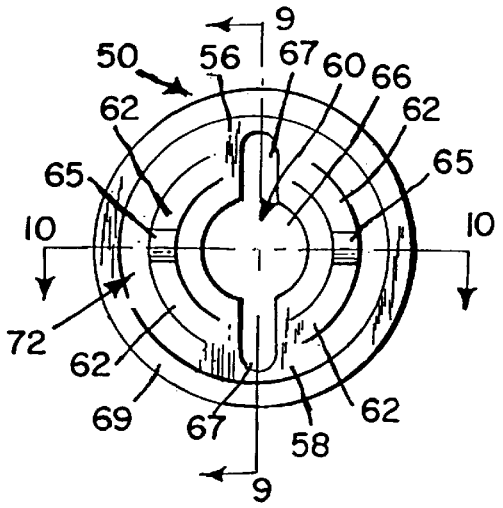
FIG. 8 is an enlarged end view of the adapter, looking in the direction of arrow 8 of FIG. 7.
Figure 9:
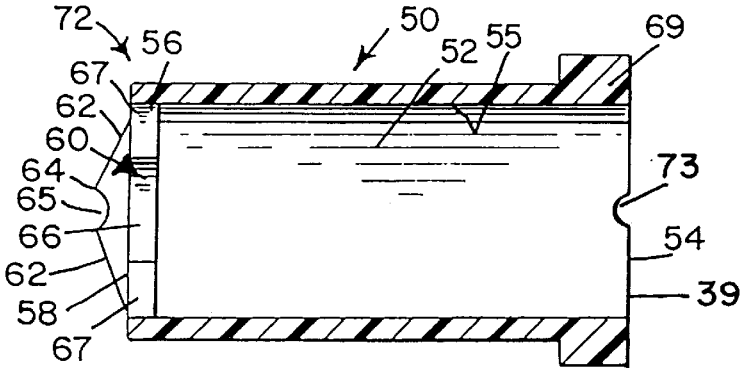
FIG. 9 is a horizontal cross-sectional view of the adapter, taken along the line 9—9 of FIG. 8 and looking in the direction of the arrows.
Figure 10:
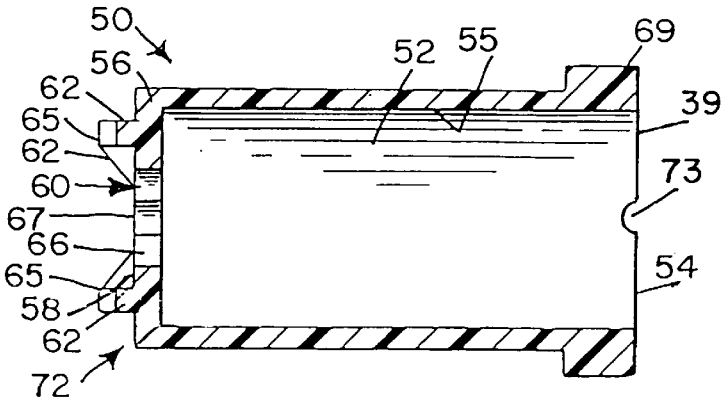
FIG. 10 is a vertical cross-sectional view of the adapter, taken along the line 10—10 of FIG. 8, and looking in the direction of the arrows.
Figure 13:
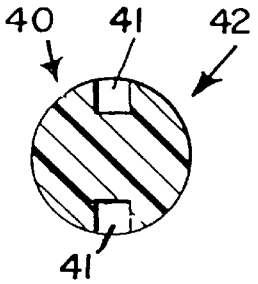
FIG. 13 is a vertical cross-section of the nock shown in FIG. 4, taken along the line 13—13 of FIG. 4 and looking in the direction of the arrows.
Figure 14:
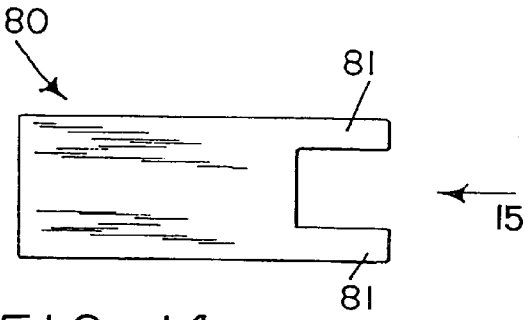
FIG. 14 is a top plan view of a tool for dislodging a broken nock from the arrow.
Figure 15:
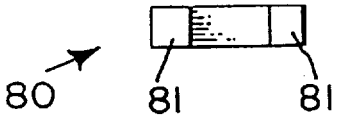
FIG. 15 is an end view of the dislodging tool, looking in the direction of arrow 15 of FIG. 14.

In the event of the previously discussed "Robin Hood" shot or other damage to the nock 40, a common location of breakage is near the line 13—13 of FIG. 4 In the event of such breakage, the ends of the grooves 41 will be accessible to the archer, as shown in FIG. 13. The archer may then use the dislodging tabs 81 of a dislodging tool 80, as shown in FIGS. 14 and 15, in the ends of the grooves 41 to remove the forward portion of nock 40 from the adapter 50, prior to installing a new nock 40. The tool 80 is used by inserting the tabs 81 into the grooves 41 and rotating the tool 80 about the central longitudinal nock axis 46. This effectively rotates the nock 40 to a non-locking angular position so that the broken forward portion of the nock 40 can be easily removed from the adapter 50.

It is contemplated that minor changes may be made in the form and construction of the invention without departing from the material spirit thereof. It is not, however, desired to confine the invention to the exact form herein shown and described, but it is desired to include all such as properly come within the scope claimed.

The invention having been thus described, what is claimed as new and desired to secure by Letters Patent is:

1. A nock assembly, for an arrow, the arrow having a shaft and at least one vane, the shaft having an outer cylindrical surface, a central longitudinal shaft axis, a bore which extends along said axis, and a first rear opening to the bore, the vane being fixed to the outer cylindrical surface, which nock assembly comprises:

(a) an adapter for being fixed to said shaft within the bore at the first rear opening in a predetermined angular position about said shaft axis relative to the vane, said adapter having a socket which has an inner cylindrical surface, said adapter having a rear end, a rearwardly facing surface at the rear end of the adapter, and a second rear opening to the socket in said rearwardly facing surface, said adapter having a forward end, a wall at said forward end which is perpendicular to the shaft axis, said wall having an aperture and a forward surface, said aperture having a central portion and a lateral portion;

(b) a nock having a head end, a tail end which has a rearwardly facing notch, and a central longitudinal nock axis which is coaxial with said shaft axis, said nock being removably mounted to said adapter so that said head end is located within said socket and said tail end is located outside of said socket, said head end having an outer cylindrical surface and a reduced forward portion, said tail end having a forwardly facing surface at the juncture of said tail end and said head end so that said forwardly facing surface abuts said rearwardly facing surface when said head end is fully located within said socket, said nock being rotatable about said central longitudinal nock axis within said socket relative to said adapter between a predetermined locking position and a predetermined non-locking position; and (c) retaining means for releasably locking the head end of said nock in said predetermined locking angular position, said retaining means comprising:

(1) at least one resiliently bendable locking pin which extends laterally and outwardly from the reduced portion of said head end of the nock, said pin being spaced from said inner cylindrical surface when said reduced portion is within said socket, said reduced portion extending freely through said central portion and said locking pin is forward of and aligned with said lateral portion when said nock is in said predetermined non-locking position;

(2) detent means on said adapter for releasably retaining the locking pin when said nock is in said predetermined locking angular position, said detent means comprising a depression in said forward surface for receiving said locking pin, said depression being spaced from the lateral portion of said aperture, said pin being forward of and aligned with said depression when said nock is in said predetermined locking position; a portion of said forward surface being a cam surface which tapers gradually forward from the lateral portion of said aperture to said depression so that when said nock is rotated about said shaft axis from said non-locking position to said locking position, said pin slides along said cam surface from the lateral portion of said aperture to said depression, said pin having a rearward surface which is rearward of said cam surface when said head end is fully located within said socket and said nock is in said non-locking position so that said pin bends forwardly as it slides along said forward surface, thereby biasing said nock forwardly relative to said adapter and creating a resistance to rotational movement of said nock relative to said adapter when said pin is in said depression.

2. A nock assembly as recited in claim 1, wherein one of said forwardly facing surface and said rearwardly facing surface has a depression and the other of said forwardly facing and said rearwardly facing surface has a protrusion for engaging said depression when said nock is in said locking angular position relative to said adapter for providing additional locking of said nock in said locking angular position.

3. A nock assembly as recited in claim 1, wherein the tail end of said nock has a slot spaced forwardly of said rearwardly facing notch and a dividing wall between said slot and said rearwardly facing notch, said dividing wall having a hole which extends from said rearwardly facing notch to said slot, said aperture enabling an elongated animal scent impregnated insert to be introduced into said slot through said hole so that a portion of said insert lies within said hole for retaining said insert within said slot.

4. A nock assembly as recited in claim 3, wherein the forward end of said slot has a rearwardly facing surface which contains a cavity for receiving said insert for providing with said hole a two point support for said insert.

5. A nock assembly, for an arrow, the arrow having a shaft and at least one vane, a central longitudinal shaft axis, a bore which extends along said axis, and a first rear opening to the bore, the vane being fixed to the outer cylindrical surface, which nock assembly comprises:

(a) an adapter for being fixed to the shaft within the bore at the first rear opening in a predetermined angular position about said shaft axis relative to the vane, said adapter having a socket, a rearwardly facing surface, and a second rear opening to the socket in said rearwardly facing surface;

(b) a nock having a head end, a tail end which has a rearwardly facing notch, and a central longitudinal nock axis which is coaxial with said shaft axis, said nock being removably mounted to said adapter so that said head end is located within said socket and tail end is located outside of said socket, said tail end having a forwardly facing surface at the juncture of said tail end and said head end so that said forwardly facing surface abuts said rearwardly facing surface when said head end is fully located within said socket; and (c) retaining means for releasably locking the head end of said nock within the socket so that the nock is in a predetermined locking angular position about the shaft axis relative to the adapter and the vane and is in a predetermined position lengthwise of the shaft axis relative to the second opening, said retaining means comprising:

(1) biasing means for biasing said nock forwardly relative to said adapter; and (2) detent means at said rearwardly facing and forwardly facing surfaces for functioning in cooperation with said biasing means for releasably retaining said nock in said locking angular position relative to said adapter.

6. A nock assembly as recited in claim 5, wherein said detent means comprises a depression in one of said forwardly facing surface and said rearwardly facing surface and a protrusion in the other of said forwardly facing surface and said rearwardly facing surface for engaging said depression when said nock is in said locking angular position relative to said adapter.

7. A nock assembly as recited in claim 5, wherein the tail end of said nock has a slot spaced forwardly of said rearwardly facing notch and a dividing wall between said slot and said rearwardly facing notch, said dividing wall having an aperture which extends from said rearwardly facing notch to said slot, said aperture enabling an elongated animal scent impregnated insert to be introduced into said slot through said aperture so that a portion of said insert lies within said aperture for retaining said insert within said slot.

8. A nock assembly as recited in claim 5, wherein the forward end of said slot has a rearwardly facing surface which contains a hole for receiving said insert for providing a two point support for said insert.

9. A nock assembly, for an arrow, the arrow having a shaft and at least one vane, the shaft having an outer cylindrical surface, a central longitudinal shaft axis, a bore which extends along said axis, and a first rear opening to the bore, the vane being fixed to the outer cylindrical surface, which nock assembly comprises:

(a) an adapter for being fixed to the shaft within the bore at the first rear opening in a predetermined angular position about said shaft axis relative to the vane, said adapter having a socket and a second rear opening to the socket;

(b) a nock having a head end, a tail end which has a rearwardly facing notch, and a central longitudinal nock axis which is coaxial with said shaft axis, said nock being removably mounted to said adapter so that said head end is located within said socket and tail end is located outside of said socket, said tail end having a slot spaced forwardly of said rearwardly facing notch and a dividing wall between said slot and said rearwardly facing notch, said dividing wall having an aperture which extends from said rearwardly facing notch to said slot, said aperture enabling an elongated animal scent impregnated insert to be introduced into said slot through said aperture so that a portion of said insert lies within said aperture for retaining said insert within said slot; and (c) retaining means for releasably locking the head end of said nock within the socket so that the nock is in a predetermined locking angular position about the shaft axis relative to the adapter and the vane and is in a predetermined position lengthwise of the shaft axis relative to the second opening.

10. A nock assembly as recited in claim 9, wherein the forward end of said slot has a rearwardly facing surface which contains a hole for receiving said insert for providing a two point support for said insert.

* * * * *